US009203144B2

(12) United States Patent
De Luis et al.

(10) Patent No.: US 9,203,144 B2
(45) Date of Patent: Dec. 1, 2015

(54) RECONFIGURABLE MULTIBAND ANTENNA DECOUPLING NETWORKS

(71) Applicant: Microsoft Corporation, Redmond, WA (US)

(72) Inventors: Javier R. De Luis, Redmond, WA (US); Alireza Mahanfar, Bellevue, WA (US); Benjamin Shewan, Redmond, WA (US); Stanley Ng, Bellevue, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 227 days.

(21) Appl. No.: 13/707,500

(22) Filed: Dec. 6, 2012

(65) Prior Publication Data

US 2014/0159986 A1 Jun. 12, 2014

(51) Int. Cl.

| | |
|---|---|
| ***H01Q 1/50*** | (2006.01) |
| ***H01Q 1/52*** | (2006.01) |
| *H01Q 1/24* | (2006.01) |
| *H01Q 21/28* | (2006.01) |

(52) U.S. Cl.

CPC ..... *H01Q 1/50* (2013.01); *H01Q 1/521* (2013.01); *H01Q 1/243* (2013.01); *H01Q 21/28* (2013.01)

(58) Field of Classification Search

CPC ..... H01Q 1/50; H01Q 1/521; H01Q 1/243; H01Q 21/28

USPC ..... 343/702, 852, 853, 850

See application file for complete search history.

(56) References Cited

U.S. PATENT DOCUMENTS

| | | | | |
|---|---|---|---|---|
| 7,482,887 | B2 | 1/2009 | Cyr et al. | |
| 8,542,158 | B2 * | 9/2013 | Rowson et al. | 343/853 |
| 8,866,691 | B2 * | 10/2014 | Montgomery et al. | 343/844 |
| 2009/0027286 | A1 | 1/2009 | Ohishi et al. | |
| 2011/0163937 | A1 | 7/2011 | Jung et al. | |
| 2011/0228713 | A1 | 9/2011 | Alexopoulos et al. | |

(Continued)

FOREIGN PATENT DOCUMENTS

| | | |
|---|---|---|
| WO | WO 2011/148225 | 12/2011 |
| WO | WO 2012/144198 | 10/2012 |
| WO | WO 2012/158693 | 11/2012 |

OTHER PUBLICATIONS

Lau, et al., "Antenna Design Challenges and Solutions for Compact MIMO Terminals", In International Workshop Antenna Technology, Mar. 7, 2011, 4 pages.

(Continued)

*Primary Examiner* — Hoanganh Le

(74) *Attorney, Agent, or Firm* — Mila Sula; Judy Yee; Micky Minhas

(57) ABSTRACT

Multiband antenna decoupling networks and systems including multiband antenna decoupling networks are provided herein. A multiband decoupling network is connected to two or more closely spaced antennas. The multiband decoupling network includes lumped components and is reconfigurable to decouple the two or more antennas at a plurality of distinct communication frequency bands. The multiband decoupling network may include tunable lumped components and be reconfigurable through tuning the tunable lumped components. A pi network may be used for the multiband decoupling network. At least one separate impedance-matching network may also be used to match the input impedance of the multiband decoupling network to the output impedance of transmission lines leading to the multiband decoupling network.

20 Claims, 11 Drawing Sheets

(56) References Cited

U.S. PATENT DOCUMENTS

| | | | | |
|---|---|---|---|---|
| 2011/0254749 | A1 | 10/2011 | Amari et al. | |
| 2012/0046003 | A1 | 2/2012 | Ying | |
| 2012/0086611 | A1 | 4/2012 | Egawa et al. | |
| 2012/0106613 | A1 | 5/2012 | Piazza et al. | |
| 2013/0162497 | A1* | 6/2013 | Satou et al. | 343/853 |

OTHER PUBLICATIONS

Raines, et al., "Design of Multiband Reconfigurable Antennas", In Proceedings of the Fourth European Conference on Antennas and Propagation, Apr. 12, 2010, 5 pages.

Mak, et al., "Reconfigurable Multiband Antenna Designs for Wireless Communication Devices", In IEEE Transactions on Antennas and Propagation, Jul. 7, 2007, 10 pages.

Tang, et al., "Tunable Decoupling and Matching Network for Diversity Enhancement of Closely Spaced Antennas," IEEE Antennas and Wireless Propagation Letters, 2012, 5 pages.

Paul Tomatta, "Antenna challenges in smartphones and tablets with 4G rising," http://www.eetimes.com/design/microwave-rf-design/4213586/Antenna-challenges-in-smartphones-and-tablets-with-4G-rising?Ecosystem=analog-design, Feb. 28, 2011, 2 pages.

Skycross, "Verizon Wireless and Alcatel-Lucent Show Live 4G LTE Multi-Continent Gaming Over Commercial 4G LTE Network from Mobile World Congress," http://www.skycross.com/News/2011/021411_LTE_Demo_MWC.asp, Feb. 14, 2011, 2 pages.

Dossche et al., "Optimum antenna matching to minimise signal correlation on a two-port antenna diversity system," Electronics Letters, vol. 40 No. 19, Sep. 16, 2004, 2 pages.

Andersen et al., "Decoupling and descattering networks for antennas," Antennas and Propagation, IEEE Transactions on, vol. 24, No. 6, Nov. 1976, 6 pages.

Chen et al., "A Decoupling Technique for Increasing the Port Isolation Between Two Strongly Coupled Antennas," Antennas and Propagation, IEEE Transactions on, vol. 56, No. 12, Nov. 1976, 9 pages.

Diallo et al., "Study and Reduction of the Mutual Coupling Between Two Mobile Phone PIFAs Operating in the DCS1800 and UMTS Bands," Antennas and Propagation, IEEE Transactions on, vol. 54, No. 11, Nov. 2006, 12 pages.

International Search Report and Written Opinion, PCT Application No. PCT/US2013/073738, 12 pages, Mar. 14, 2014.

* cited by examiner

RECONFIGURABLE MULTIBAND ANTENNA DECOUPLING NETWORKS

FIELD

The present application relates generally to antenna decoupling networks.

BACKGROUND

Mobile computing devices have been widely adopted in recent years. Many functions previously performed primarily by personal computers, such as web browsing, streaming, and uploading/downloading of media are now commonly performed on mobile devices. Consumers continue to demand smaller, lighter devices with increased computing power and faster data rates to accomplish these tasks.

Many mobile devices include multiple antennas to provide data rates that satisfy consumers' ever-increasing requirements for upload and download speeds. Integrating multiple antennas into a small form factor device such as a mobile phone or tablet creates the possibility of electromagnetic coupling between antennas. Such electromagnetic coupling has many disadvantages. For example, system efficiency is reduced because signal energy radiated from one antenna is received by another device antenna instead of being radiated toward an intended target. Coupling between antennas becomes even more problematic when the antennas operate at the same or similar frequency bands.

Decoupling networks have been used to decouple antennas from each other. Typically, because a transmitted signal is known, an out-of-phase version of the transmitted signal can be fed to other antennas to which the transmitted signal is electromagnetically coupled. This creates destructive interference that decouples the antennas.

Conventional decoupling networks, however, suffer from several substantial drawbacks. For example, conventional decoupling networks operate at a single frequency. This prevents devices with antennas operating at multiple frequency bands from being simultaneously decoupled for all of the multiple frequency bands. Additionally, the out-of-phase signal used for decoupling is conventionally created using lengths of transmission line that provide the required decoupling conditions. The length of transmission line necessary to create the decoupling conditions is frequency dependent, which not only limits the decoupling network to one frequency of operation but creates space concerns for lower frequencies in smaller form factor designs.

SUMMARY

Embodiments described herein relate to reconfigurable multiband antenna decoupling networks. Using the systems described herein, two nearby antennas can be decoupled at a plurality of frequency bands. In one embodiment, a multiband decoupling network is connected to two or more antennas and is reconfigurable to decouple the two or more antennas at a plurality of distinct communication frequency bands. The multiband decoupling network comprises a plurality of lumped components.

In some embodiments, the multiband decoupling network comprises one or more tunable lumped components and is reconfigurable to decouple two or more antennas at a plurality of distinct communication frequency bands through tuning the one or more tunable lumped components.

In other embodiments, the multiband decoupling network is a pi network in which a first element providing a reactance is connected to a first antenna. A second element providing a reactance is connected to a second antenna. A third element providing a susceptance is connected between the ends of the first and second elements opposite the first and second antennas.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The foregoing and other objects, features, and advantages of the claimed subject matter will become more apparent from the following detailed description, which proceeds with reference to the accompanying figures.

DETAILED DESCRIPTION

Embodiments described herein provide reconfigurable multiband antenna decoupling networks. Using the systems described herein, closely spaced antennas can be decoupled. If both antennas are part of the same system (e.g., a mobile device), such coupling is often undesirable. For closely spaced antennas, the close proximity of the antennas is insufficient to decouple the antennas through distance alone. Instead, undesirable coupling can be addressed through the use of decoupling networks. As used herein, "closely spaced" refers to antennas that are near enough together such that a portion of a signal transmitted by one antenna is electromagnetically coupled to another antenna, the coupling being significant enough to detrimentally affect the performance of either antenna if a decoupling network is not used. Embodiments are described in detail below with reference to FIGS. 1-11.

Figure 1:
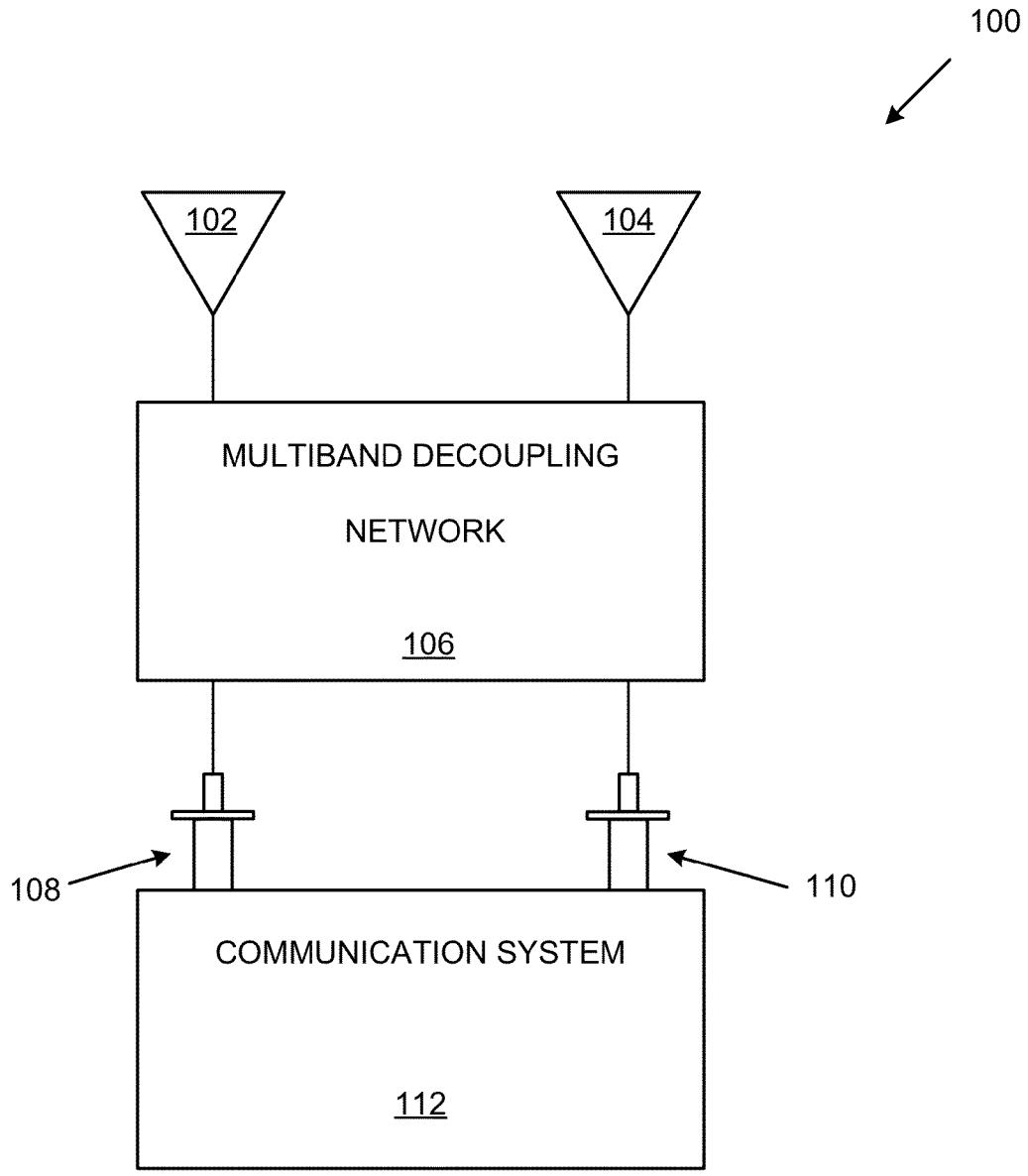
FIG. 1 is a block diagram illustrating an exemplary system having a multiband decoupling network.

FIG. 1 illustrates an exemplary system 100. System 100 includes closely spaced antennas 102 and 104. Multiband decoupling network 106 decouples antennas 102 and 104 and is connected between antennas 102 and 104 and connectors 108 and 110. Connectors 108 and 110 connect a communication system 112 to antennas 102 and 104 via multiband decoupling network 106. Communication system 112 is beyond the scope of this application but can include various hardware and/or software components that, for example, generate signals for transmission by antennas 102 and 104 or process signals received by antennas 102 and 104. In some embodiments, system 100, including communication system 112, is part of a mobile device such as a mobile phone, smart phone, or tablet computer.

In some embodiments, antennas 102 and 104 are capable of both receiving and transmitting signals. Received signals are communicated to communication system 112 through connectors 108 and 110, and transmitted signals are communicated from the communication system to antennas 102 and 104 through connectors 108 and 110.

Multiband decoupling network 106 is reconfigurable to decouple antennas 102 and 104 at a plurality of distinct communication frequency bands. Multiband decoupling network 106 decouples antennas 102 and 104 by providing out-of-phase versions of a transmitted signal to the non-transmitting antenna. For example, if a signal is provided through connector 108 to antenna 102, an out-of-phase version of the signal is provided to antenna 104 to create destructive interference and eliminate the coupling between antenna 102 and antenna 104.

In some embodiments, antennas 102 and 104 are designed to operate at a plurality of distinct communication frequency bands. For example, in communication standards such as 4G LTE communications, as many as 40 or more distinct communication frequency bands can be used. In one embodiment, antennas 102 and 104 are designed to communicate at between approximately 4 and 12 distinct communication frequency bands. Because it is "multiband," multiband decoupling network 106 is able to decouple antennas 102 and 104 at multiple distinct communication frequency bands, whereas conventional decoupling networks generally decouple at only a single frequency.

Multiband decoupling network 106 comprises a plurality of lumped components (not shown), including capacitors and/or inductors. "Lumped components" as used herein are discrete components and may have either a specified value or may be adjustable or "tunable" over a value range. Examples of lumped components include surface-mount components (SMCs, also known as surface-mount devices, SMDs), which are small and inexpensive. Transmission line segments are not considered to be "lumped components" in this application.

Multiband decoupling network 106 creates an out-of-phase signal by providing a reactance and/or a susceptance. Reactance and susceptance are defined by the following equations:

$$Z=R+jX \tag{1}$$

$$Y=G+jB \tag{2}$$

As shown in equations 1 and 2, impedance, Z, and admittance, Y, have both real and imaginary components. Impedance is equal to the sum of the real resistance, R, and the imaginary reactance, jX (equation 1). Admittance is equal to the sum of the real conductance, G, and the imaginary susceptance, jB (equation 2). Admittance is the inverse of impedance. Reactance and susceptance can be provided using capacitors and inductors. Segments of transmission line such as coaxial cable, microstrip, stripline, and other transmission lines can also provide a combination of reactance and susceptance.

In some embodiments, one or more of the plurality of lumped components in multiband decoupling network 106 is tunable, and multiband decoupling network 106 is reconfigurable to decouple antennas 102 and 104 at a plurality of distinct communication frequency bands through tuning the one or more tunable lumped components. Tunable components such as tunable capacitors and tunable inductors allow selection of different capacitance/inductance values, which in turn changes the reactance or susceptance of the tunable components and adjusts the communication frequency band at which multiband decoupling network 106 decouples antennas 102 and 104. In some embodiments, multiband decoupling network 106 comprises at least one tunable resonator formed using at least one of the one or more tunable lumped components.

In other embodiments, multiband decoupling network 106 is reconfigurable through at least one switch that switches at least one of the plurality of lumped components into or out of a signal path to antenna 102 or 104. Switching in/out two different lumped components, for example, allows decoupling of antennas 102 and 104 at two different communication frequency bands corresponding to the reactances provided by the two different components. If a switch with a higher number of output throws is used, antennas 102 and 104 can be decoupled at additional distinct communication frequency bands. If at least one tunable lumped component is used, antennas 102 and 104 can be decoupled at still more distinct communication frequency bands.

Figure 3:
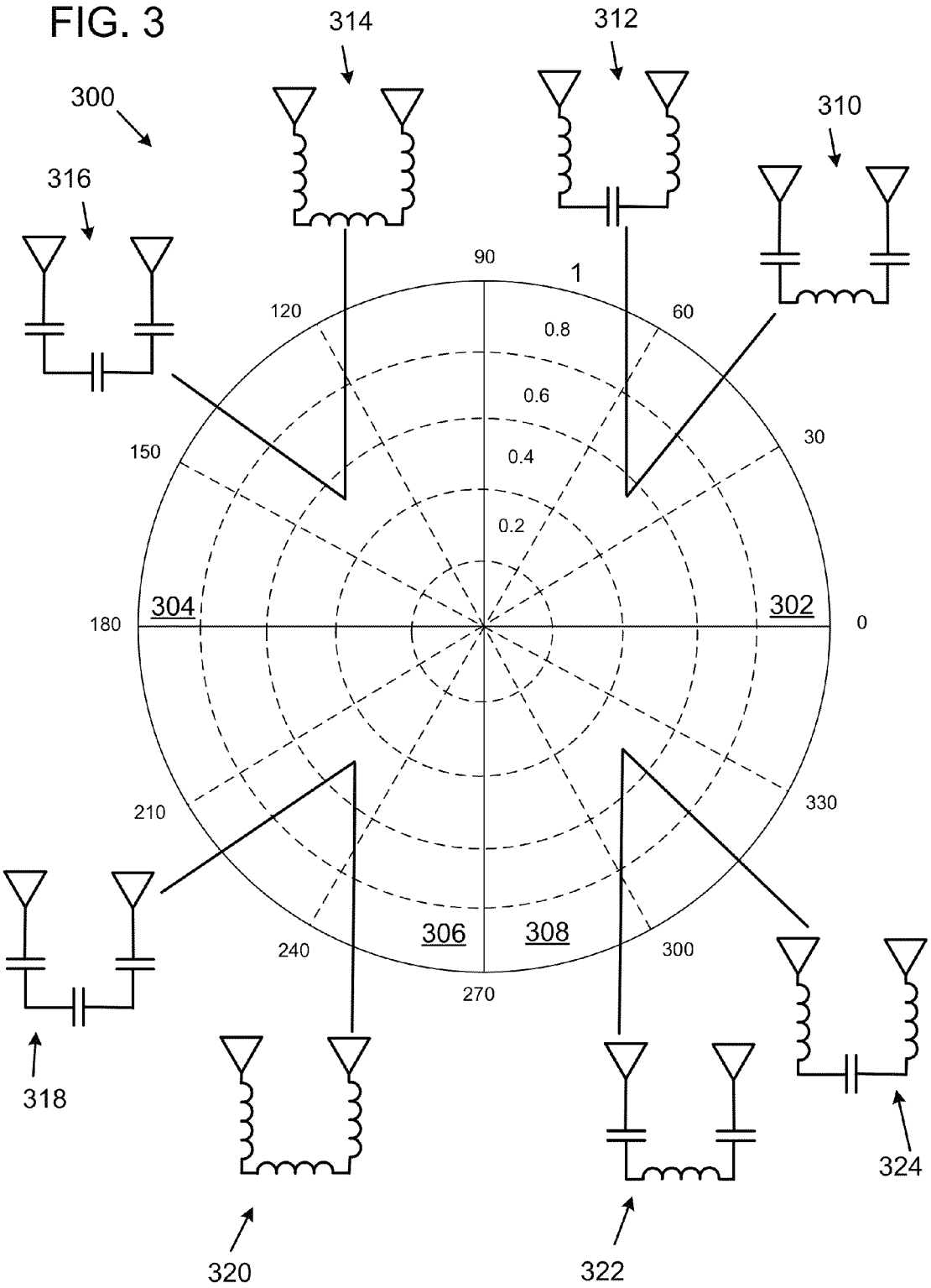
FIG. 3 is a diagram of the $S_{21}$ complex plane showing pi multiband decoupling network elements comprising lumped components to achieve decoupling for $S_{21}$ values in each quadrant.

In some embodiments, decoupling of antennas 102 and 104 is achieved substantially using the plurality of lumped components without using the reactance or susceptance provided by a transmission line to facilitate the decoupling. In other embodiments, multiband decoupling network 106 comprises at least one segment of transmission line used as a reactive element. Transmission line segments move the S21 frequency-dependent complex value in the complex plane (the complex plane is shown in FIG. 3) along a concentric circle. The amount of angular movement will depend on the operation frequency (higher frequencies experience higher angular movements than lower frequencies). If the transmission line length is properly designed, the different frequency bands to be decoupled will require the same decoupling network topology with different component values. In such embodiments, multiband decoupling network 106 can be reconfigurable to account for the different component values, for example, by including at least one tunable lumped component.

Multiband decoupling network 106 can be designed in a variety of ways. FIGS. 2-9 illustrate a "pi network." Other network types are possible.

Figure 2:
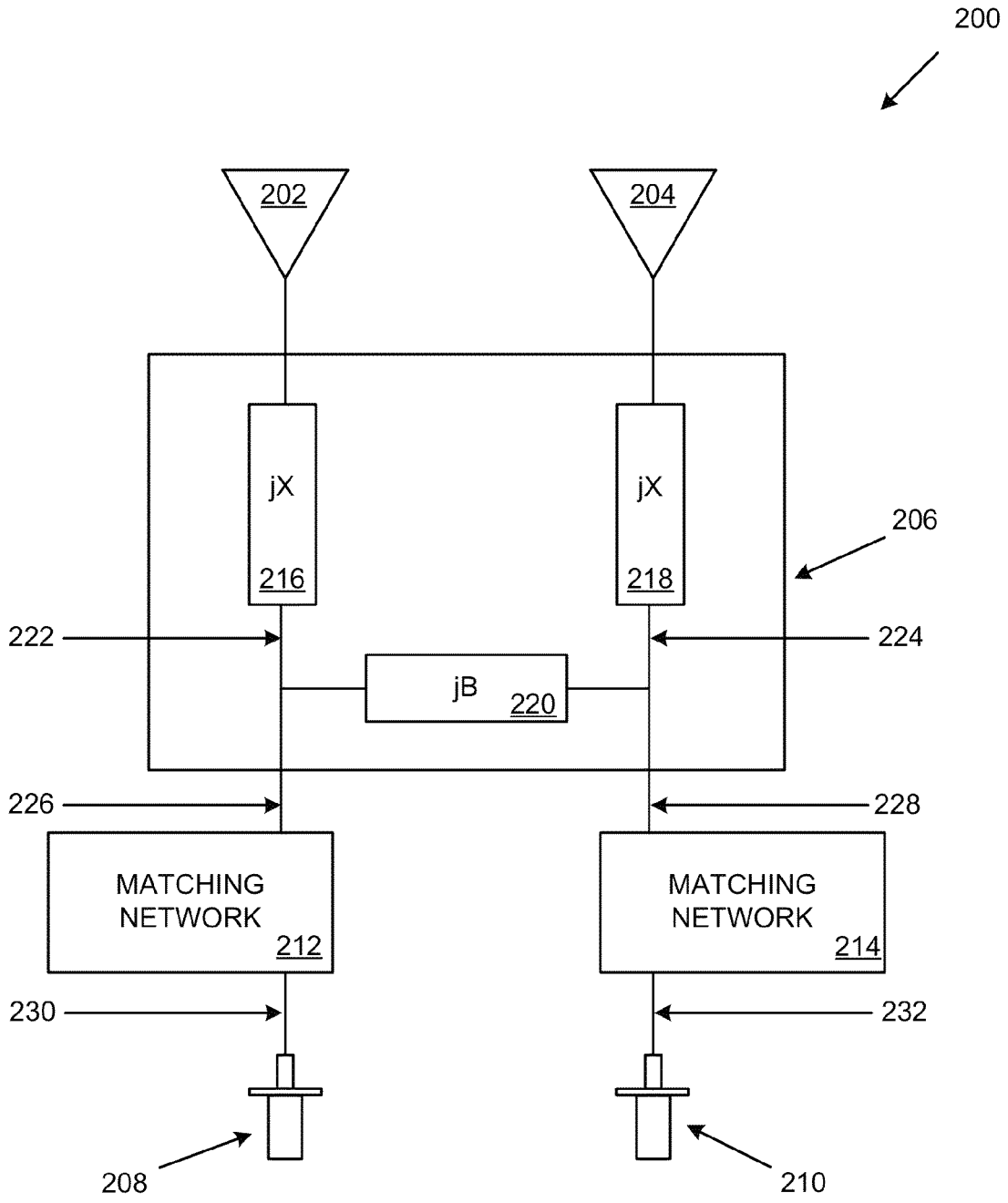
FIG. 2 is a block diagram illustrating an exemplary system having two matching networks and a "pi" multiband decoupling network.

FIG. 2 illustrates exemplary system 200. System 200 includes closely spaced antennas 202 and 204. Multiband decoupling network 206 decouples antennas 202 and 204 and is connected between antennas 202 and 204 and connectors 208 and 210. Connectors 208 and 210 connect a communication system (omitted for simplicity) to antennas 202 and 204 via impedance-matching networks 212 and 214 and multiband decoupling network 206. In some embodiments, system 200 is part of a mobile device such as a mobile phone, smart phone, or tablet computer.

Impedance-matching networks 212 and 214 provide an input impedance that substantially matches an output impedance of connectors 208 and 210 at the plurality of distinct communication frequency bands. In many conventional systems using single-frequency-band decoupling networks, the decoupling network also serves as an impedance-matching network. System 200, in contrast, includes separate impedance-matching networks 212 and 214 in addition to multiband decoupling network 206.

In some embodiments, the output impedance of connectors 208 and 210 is the output impedance of transmission lines from the communication system that terminate in connectors 208 and 210. The output impedance can be, for example, approximately 50 ohms. Impedance-matching networks 212 and 214 may be configured in a variety of ways. The details of impedance-matching networks 212 and 214 are beyond the scope of this application, but impedance-matching networks 212 and 214 may be reconfigurable by including at least one tunable lumped component. In some embodiments, a single impedance-matching network is used.

Multiband decoupling network 206 is a pi network (in this case shaped as an upside-down "π") in which a first element 216 providing a reactance jX is connected to antenna 202, a second element 218 providing a reactance jX is connected to antenna 204, and a third element 220 providing a susceptance jB is connected between the ends of first element 216 and second element 218 opposite antennas 202 and 204. The reactance jX of first element 216 is the same as the reactance jX of second element 218. As used herein, an "element" may contain a plurality of components, including lumped components.

Values for first element 216, second element 218, and third element 220 can be obtained by selecting proper constraints and applying microwave network theory equations. Scattering parameters (also known as S parameters) are used to characterize networks. The $S_{21}$ parameter represents transmission, and the $S_{11}$ parameter represents reflection. Admittance parameters (also known as Y parameters) are also used to characterize networks. The following analysis can be used to determine values for X and Bin FIG. 2.

At points 222 and 224, the constraints are that the phase of the $S_{21}$ parameter is 90 degrees and that the real part of the $Y_{21}$ parameter is zero. First element 216 and second element 218 are selected to implement these constraints, each of first element 216 and second element 218 having a reactance X calculated by $$X = \frac{z_0[j - je^{2j\phi} \pm 2e^{j\phi}]}{1 + e^{2j\phi}} \tag{3}$$

where $\phi$ is the phase of $S_{21}$ in radians and $Z_0$ is the system impedance (typically 50 ohms).

At points 226 and 228, the constraints are that the imaginary part of $Y_{21}$ is zero and that the magnitude of $S_{21}$ is zero. Third element 220 accomplishes this by providing a susceptance that cancels the imaginary part of the mutual admittance, $Y_{21}$, at points 226 and 228. With these constraints, B can be calculated by $$B = -\frac{\frac{1}{2}\alpha[e^{-j\phi} + 2e^{j\phi} + e^{3j\phi}]}{z_0\{\alpha^2 je^{2j\phi} + je^{2j\phi} - j - \alpha^2 j \pm (2\alpha^2 e^{j\phi} + 2e^{j\phi})\}} \tag{4}$$

where $\alpha$ is the magnitude of the $S_{21}$ parameter.

At points 230 and 232, the constraint is that the magnitude of the $S_{11}$ (reflection) parameter is zero. The components comprising impedance-matching networks 212 and 214 can be determined using this constraint. Impedance-matching networks 212 and 214 can include, for example, at least one inductor and at least one capacitor.

When the $S_{21}$ parameter for a system is measured (without a decoupling network), both $\alpha$ (magnitude of $S_{21}$) and $\phi$ (phase of $S_{21}$) are known, and equations 3 and 4 can be solved. Both equation 3 and equation 4 include a ± sign, indicating that for a particular $S_{21}$ value measured, there are two solutions for both X (equation 3) and B (equation 4). This is illustrated in FIG. 3.

FIG. 3 is a diagram of the $S_{21}$ complex plane 300. Each quadrant 302, 304, 306, and 308 in FIG. 3 contains alternative pi network configurations 310/312, 314/316, 318/320, and 322/324, respectively that decouple two closely spaced antennas for a given $S_{21}$ that falls within that quadrant. For each quadrant, either configuration may be used. A measured $S_{21}$ value is for a single frequency. Performing the above calculations and determining X and B values allows decoupling at the single communication frequency and surrounding band for which $S_{21}$ is measured.

The alternative configuration pairs shown in FIG. 3 illustrate a lumped component, either a capacitor or an inductor, for each of the elements of the pi network. The pi networks shown in FIG. 3 correspond to first component 216, second component 218, and third component 220 in FIG. 2. Multiband decoupling network 206, however, decouples antennas 202 and 204 at a plurality of distinct communication frequency bands.

For a dual communication frequency case, first element 216 and second element 218 can each include at least two lumped components—an inductor and a capacitor. The inductor and capacitor can either be switched in and out of the circuit to achieve decoupling at different communication frequency bands or can be arranged as a series or parallel resonator. FIGS. 4A-4D and 5 illustrate exemplary pi network topologies that can achieve decoupling at two distinct communication frequency bands. To achieve decoupling at three or more distinct communication frequency bands, tunable lumped components can be used. FIGS. 6A-9 illustrate exemplary pi network topologies for multiband decoupling network 206 that can achieve decoupling at three or more distinct communication frequency bands.

Figure 4A:
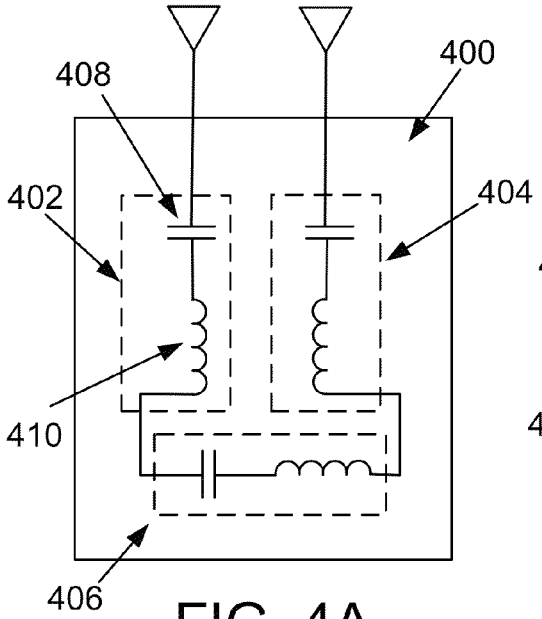
FIGS. 4A-4D illustrate exemplary pi multiband decoupling network elements each comprising a resonator.
Figure 4B:
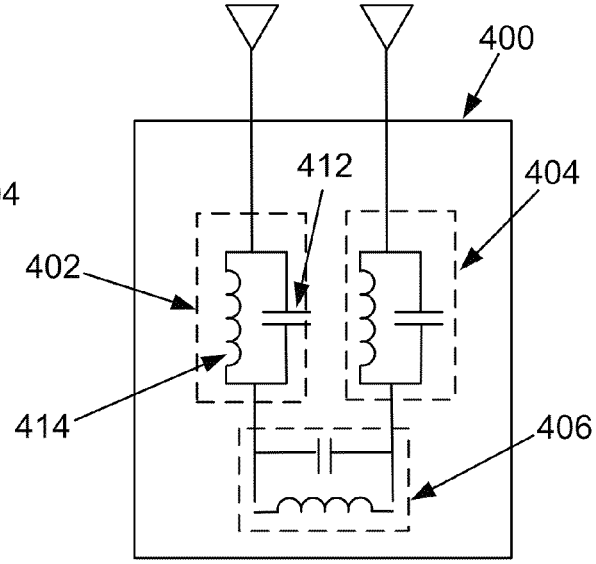
Figure 4C:
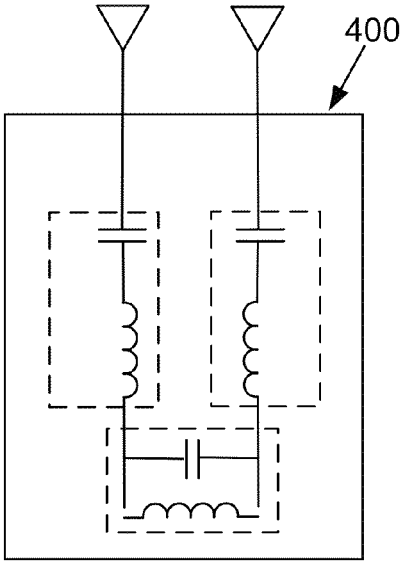
Figure 4D:
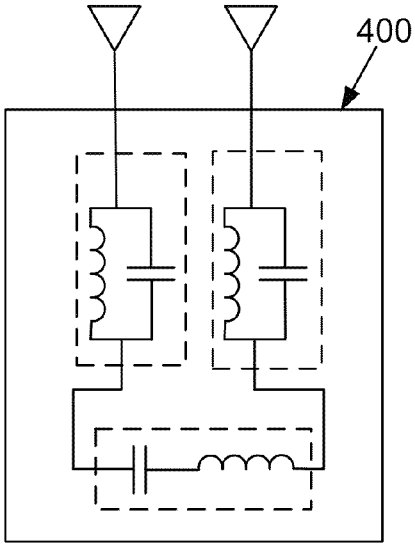

FIG. 4A illustrates multiband decoupling network 400. Multiband decoupling network 400 comprises first element 402 and second element 404 that provide a reactance and third element 406 that provides a susceptance. First element 402 comprises two lumped components, capacitor 408 and inductor 410, which together form a series resonator. Second element 404 and third element 406 similarly form series resonators. FIG. 4B illustrates an alternative topology for multiband decoupling network 400 in which each of first element 402, second element 404, and third element 406 comprise parallel resonators. For example, first element 402 comprises capacitor 412 and inductor 414 in parallel, forming a parallel resonator. FIGS. 4C and 4D illustrate topologies for multiband decoupling network 400 in which some elements comprise parallel resonators and some elements comprise series resonators. Series and parallel resonators have the ability to synthesize a capacitance at low frequencies and inductance at high frequencies and vice versa.

Figure 5:
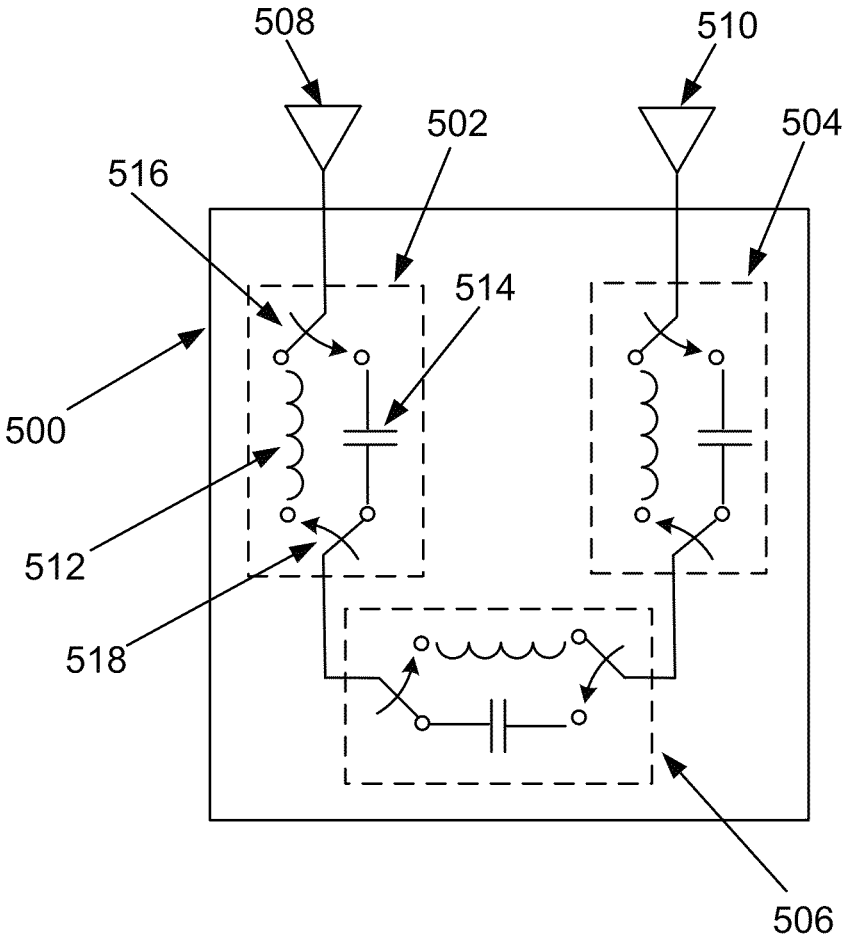
FIG. 5 illustrates exemplary pi multiband decoupling network elements each comprising switched lumped components.

Another multiband decoupling network topology for a dual frequency case is illustrated in FIG. 5. Multiband decoupling network 500 includes first element 502, second element 504, and third element 506, which each include two lumped components that are switchably connectable into a signal path of antenna 508 or antenna 510. For example, in first element 502, either inductor 512 or capacitor 514 can be switched into the signal path of antenna 508 using switches 516 and 518. Switches 516 and 518 can, for example, be controlled by a communication system to provide decoupling. Any of the topologies shown in FIG. 3 can be created by switching in/out the proper lumped components. First element 502, second element 504, and third element 506 are thus reconfigurable.

Although FIG. 5 shows only two lumped components switchably connectable, other embodiments can include switches with a higher number of output throws switching in additional lumped components. FIG. 5 also shows the two lumped components that are switchably connectable as being one capacitor and one inductor (e.g. inductor 512 and capacitor 514). In other embodiments, multiple capacitors and multiple inductors can be switched between. For example, switches 516 and 518 can switch between two or more capacitors.

Figure 6A:
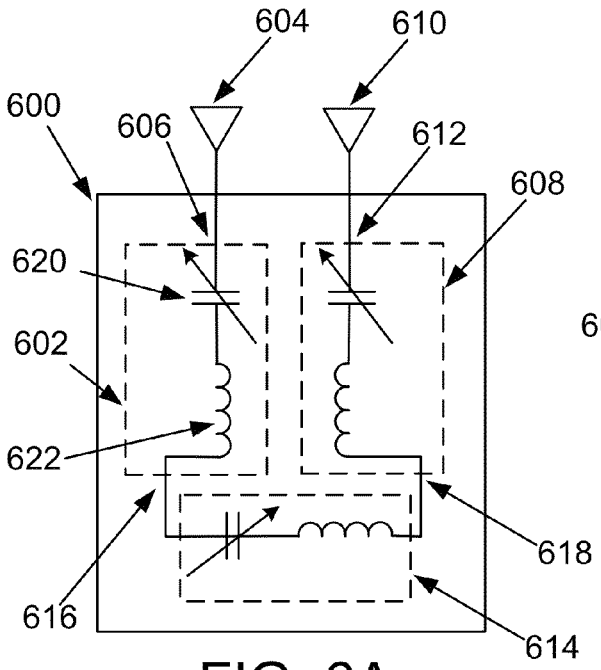
FIGS. 6A-6D illustrate exemplary pi multiband decoupling network elements each comprising a tunable resonator.

FIG. 6A illustrates a multiband decoupling network 600 in which tunable components are used. First reconfigurable element 602 having a reactance is connected to antenna 604 at an antenna side end 606. Second reconfigurable element 608 having a reactance is connected to antenna 610 at an antenna-side end 612. Third reconfigurable element 614 is connected in shunt between system-side end 616 of first reconfigurable element 602 and system-side end 618 of second reconfigurable element 608. Each of first reconfigurable element 602, second reconfigurable element 608, and third reconfigurable element 614 comprise at least one tunable lumped component. For example, first reconfigurable element 602 comprises tunable capacitor 620 and inductor 622 that together form a tunable series lumped-component resonator. Second reconfigurable element 608 and third reconfigurable element 614 similarly comprise tunable series resonators.

Multiband decoupling network 600 is reconfigurable to decouple antennas 604 and 610 at a plurality of distinct communication frequency bands. Multiband decoupling network 600 is reconfigurable at least in part by tuning the at least one tunable lumped component in each reconfigurable element. By selecting tunable lumped components having a wide range of values, a wide range of distinct communication frequency bands can be decoupled.

Figure 6B:
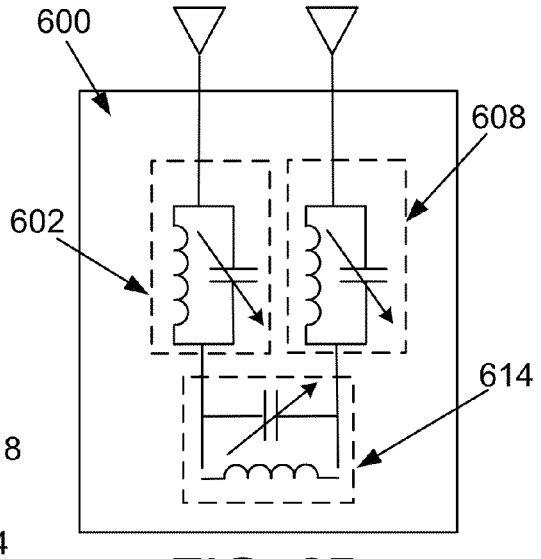
Figure 6C:
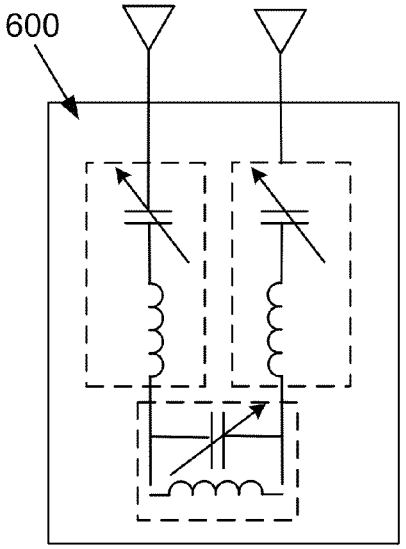
Figure 6D:
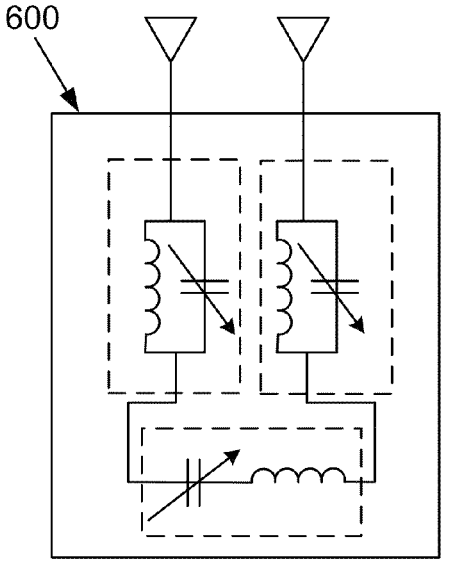

FIG. 6B illustrates multiband decoupling network 600 having tunable components in which first reconfigurable element 602, second reconfigurable element 608, and third reconfigurable element 614 each comprise a tunable capacitor and an inductor in parallel to form a parallel resonator. FIGS. 6C and 6D illustrate other topologies for multiband decoupling network 600 in which parallel or series resonators formed from tunable lumped components are used. Although FIGS. 6A-6D show tunable capacitors, tunable inductors may be used either as an alternative to tunable capacitors or in addition to tunable capacitors.

Figure 7:
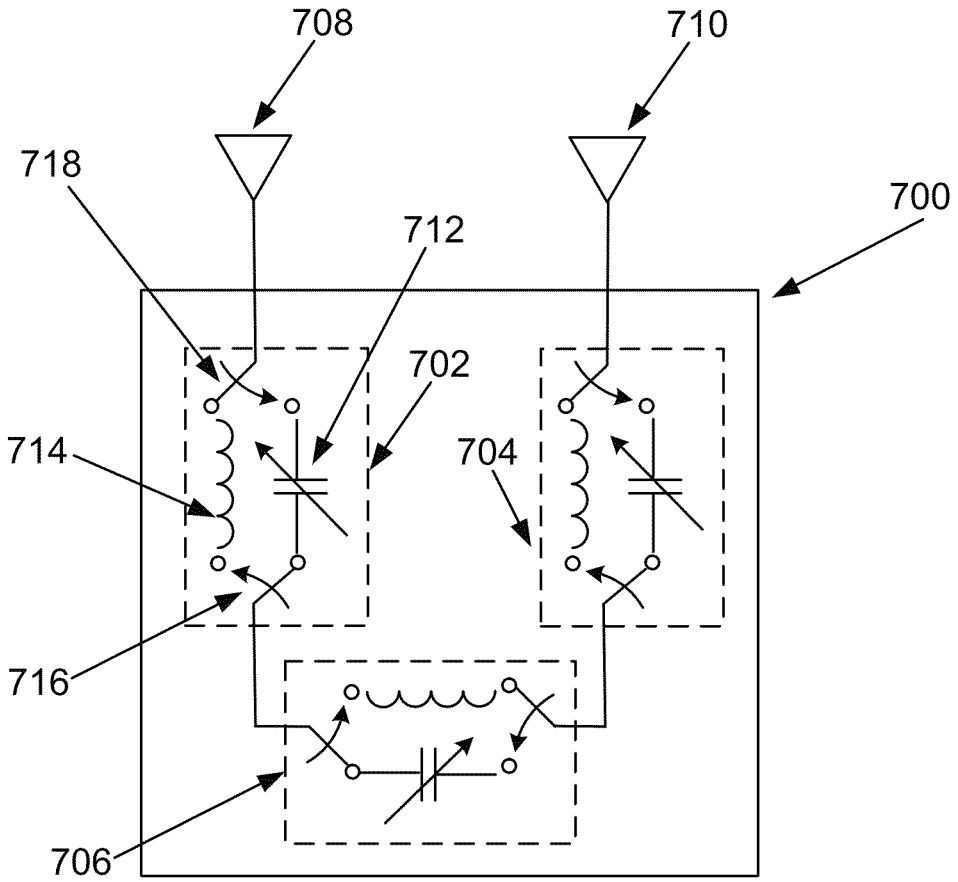
FIG. 7 illustrates exemplary pi multiband decoupling network elements each comprising switched lumped components including one tunable lumped component.

FIG. 7 illustrates a multiband decoupling network 700. Each of first reconfigurable element 702, second reconfigurable element 704, and third reconfigurable element 706 comprises two lumped components that are switchably connectable into a signal path of at least one of antenna 708 or antenna 710. In some embodiments, three or more lumped components in each reconfigurable element may be switchably connectable into an antenna signal path. In FIG. 7, each of first reconfigurable element 702, second reconfigurable element 704, and third reconfigurable element 706 comprises at least one tunable lumped component. For example, first reconfigurable element 702 comprises tunable capacitor 712 and inductor 714 that can be switched in/out of the signal path to antenna 708 using switches 716 and 718. Alternative switching configurations and a variety of switches or components used as switches are possible.

Figure 8A:
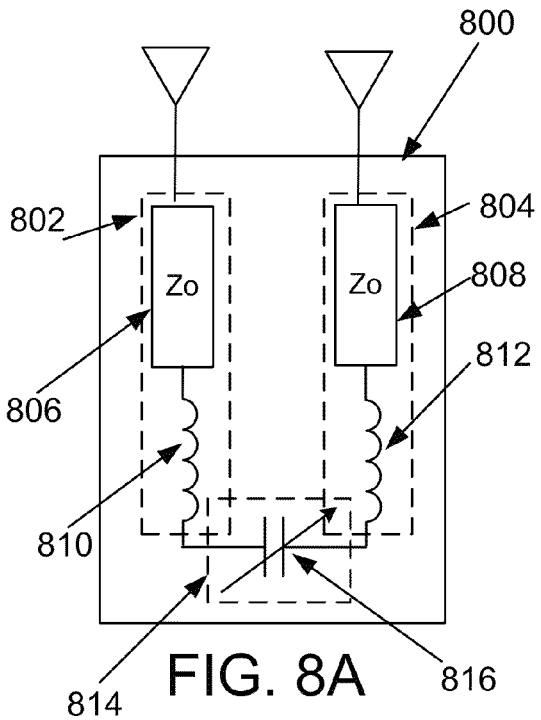
FIGS. 8A-8C illustrate exemplary pi multiband decoupling network elements with at least some of the elements including segments of transmission line used as a reactive element.

FIG. 8A illustrates a multiband decoupling network 800 in which first element 802 and second element 804 include segments of transmission line 806 and 808 used as reactive elements to provide a reactance at a plurality of distinct communication frequency bands. Transmission line segments 806 and 808 may have an impedance equal to the system impedance of $Z_0$ as well as a frequency-dependent reactance. First element 802 and second element 804 also include lumped components 810 and 812. In some embodiments, additional lumped components are included in first element 802 and 804. Third element 814 is a tunable capacitor 816.

By using transmission line segments 806 and 808, the $S_{21}$ measured without a decoupling network for multiple frequency bands can be forced into the same quadrant of the complex plane to allow the use of fewer lumped components in the elements of multiband decoupling network 806. As shown in FIG. 3, if the measured $S_{21}$ values fall in the same quadrant for all of the distinct communication frequency bands at which a decoupling network will be used, a topology including only one lumped component in each of first element 802, second element 804, and third element 814 can be used. A greater number of distinct communication frequency bands can be decoupled by making some or all of these lumped components tunable, as shown in FIGS. 8A-8C.

Figure 8B:
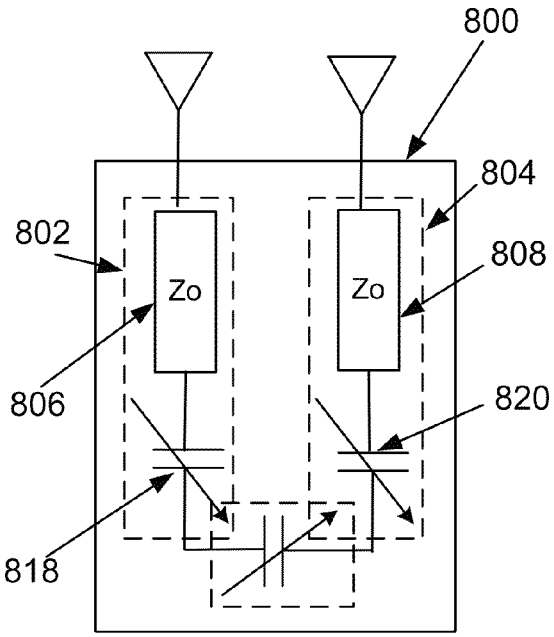
Figure 8C:
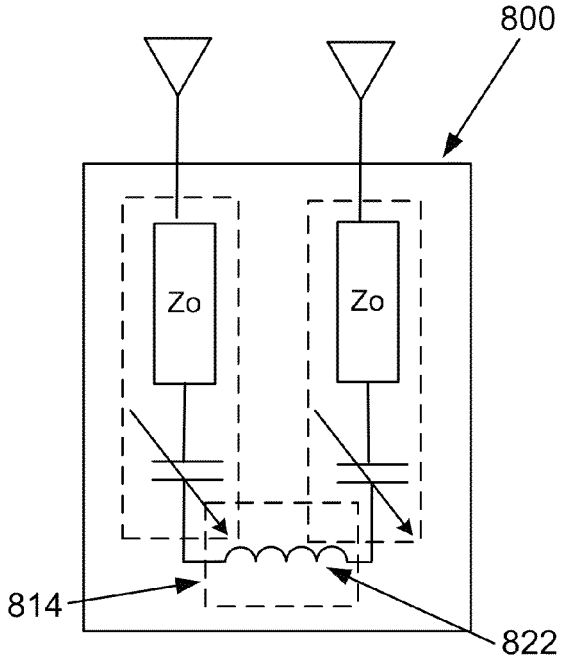

FIG. 8B illustrates multiband decoupling network 800 having a topology in which first element 802 comprises transmission line segment 806 in series with tunable capacitor 818 and second element 804 comprises transmission line segment 808 in series with tunable capacitor 820. FIG. 8C illustrates still another topology possibility for multiband decoupling network 800 in which third element 814 is an inductor 822.

Figure 9:
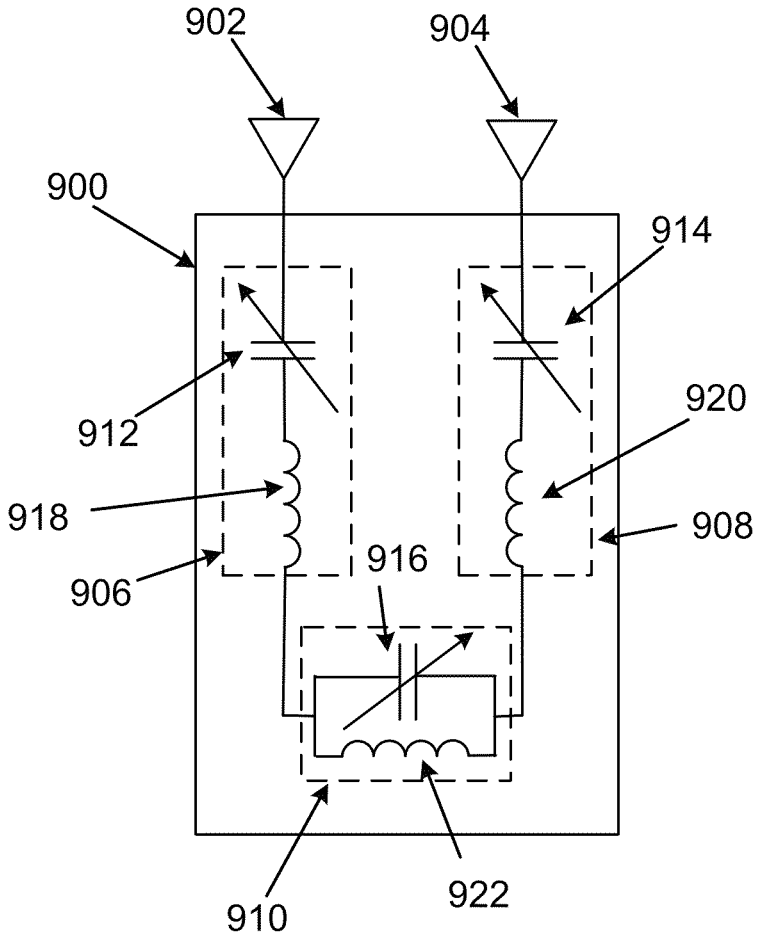
FIG. 9 is a diagram of a tested pi multiband decoupling network.

FIG. 9 illustrates an exemplary multiband decoupling network 900 that has been tested at two frequency bands. Multiband decoupling network 900 is connected to antenna 902 and 904 and is reconfigurable to decouple antennas 902 and 904 at a plurality of distinct communication frequency bands. For test purposes, frequency bands with center frequencies of 820 MHz and 1750 MHz were used. Multiband decoupling network 900 comprises a first element 906 having a reactance connected to antenna 902 and a second element 908 having a reactance connected to antenna 904. A third element 910 having a susceptance is connected in shunt between the ends of first element 906 and second element 908 opposite antennas 902 and 904. First element 906, second element 908, and third element 910 each comprise at least one tunable lumped component, in this case tunable capacitors 912, 914, and 916, which each form a series or parallel resonator with inductors 918, 920, and 922, respectively. Multiband decoupling network 900 is reconfigurable at least in part by tuning tunable capacitors 912, 914, and 916.

Component values were determined as follows: inductors 918 and 920=10 nH; inductor 922=6.8 nH; tunable capacitors 912 and 914=1.3 pF (for 1750 MHz) and 5 pF (for 820 MHz); and tunable capacitor 916=2 pF (for 1750 MHz) and 1 pF (for 820 MHz). Before implementing multiband decoupling network 900, the $S_{21}$ parameter is measured at −5.5 dB for 820 MHz and −4 dB for 1750 MHz. Multiband decoupling network 900 reduces the coupling between antennas 902 and 904 to extremely low levels of −20 dB for 820 MHz and −29 dB for 1750 MHz.

As discussed above, reactance and susceptance can be generated by lumped component inductors and/or capacitors as well as lengths of transmission lines. The particular components included in the embodiments illustrated in FIGS. 3-9 are merely illustrative. It is understood that other topologies are also within the scope of the claims, including combinations of portions of the illustrated topologies. FIGS. 1-9 illustrate two antennas. Additional antennas may also be decoupled. Capacitance and inductance can be achieved with single lumped components or multiple lumped components. It is understood that where one lumped component is shown, additional lumped components having equivalent capacitance or inductance can also be used.

Exemplary Mobile Device

Figure 10:
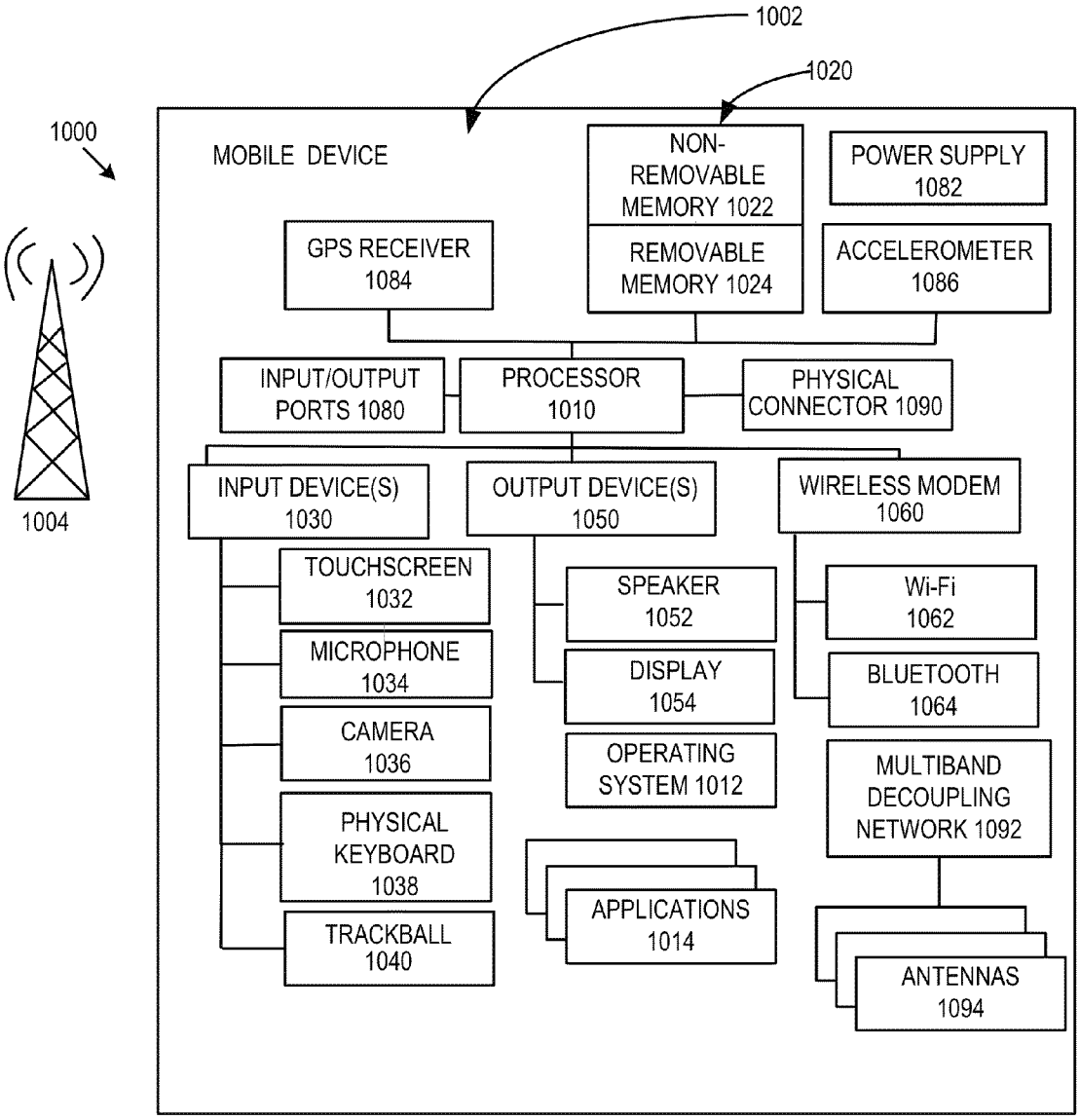
FIG. 10 is a diagram of an exemplary mobile phone having multiple antennas and a multiband decoupling network.

FIG. 10 is a system diagram depicting an exemplary mobile device 1000 including a variety of optional hardware and software components, shown generally at 1002. Any components 1002 in the mobile device can communicate with any other component, although not all connections are shown, for ease of illustration. The mobile device can be any of a variety of computing devices (e.g., cell phone, smartphone, handheld computer, Personal Digital Assistant (PDA), etc.) and can allow wireless two-way communications with one or more mobile communications networks 1004, such as a cellular or satellite network.

The illustrated mobile device 1000 can include a controller or processor 1010 (e.g., signal processor, microprocessor, ASIC, or other control and processing logic circuitry) for performing such tasks as signal coding, data processing, input/output processing, power control, and/or other functions. An operating system 1012 can control the allocation and usage of the components 1002 and support for one or more applications 1014. The application programs can include common mobile computing applications (e.g., email applications, calendars, contact managers, web browsers, messaging applications), or any other computing application.

The illustrated mobile device 1000 can include memory 1020. Memory 1020 can include non-removable memory 1022 and/or removable memory 1024. The non-removable memory 1022 can include RAM, ROM, flash memory, a hard disk, or other well-known memory storage technologies. The removable memory 1024 can include flash memory or a Subscriber Identity Module (SIM) card, which is well known in GSM communication systems, or other well-known memory storage technologies, such as "smart cards." The memory 1020 can be used for storing data and/or code for running the operating system 1012 and the applications 1014. Example data can include web pages, text, images, sound files, video data, or other data sets to be sent to and/or received from one or more network servers or other devices via one or more wired or wireless networks. The memory 1020 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The mobile device 1000 can support one or more input devices 1030, such as a touchscreen 1032, microphone 1034, camera 1036, physical keyboard 1038 and/or trackball 1040 and one or more output devices 1050, such as a speaker 1052 and a display 1054. Other possible output devices (not shown) can include piezoelectric or other haptic output devices. Some devices can serve more than one input/output function. For example, touchscreen 1032 and display 1054 can be combined in a single input/output device. The input devices 1030 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 1012 or applications 1014 can comprise speech-recognition software as part of a voice user interface that allows a user to operate the device 1000 via voice commands. Further, the device 1000 can comprise input devices and software that allows for user interaction via a user's spatial gestures, such as detecting and interpreting gestures to provide input to a gaming application.

A wireless modem 1060 can be coupled to an antenna (not shown) and can support two-way communications between the processor 1010 and external devices, as is well understood in the art. The modem 1060 is shown generically and can include a cellular modem for communicating with the mobile communication network 1004 and/or other radio-based modems (e.g., Bluetooth 1064 or Wi-Fi 1062). The wireless modem 1060 is typically configured for communication with one or more cellular networks, such as a GSM network for data and voice communications within a single cellular network, between cellular networks, or between the mobile device and a public switched telephone network (PSTN).

The mobile device can further include at least one input/output port 1080, a power supply 1082, a satellite navigation system receiver 1084, such as a Global Positioning System (GPS) receiver, an accelerometer 1086, and/or a physical connector 1090, which can be a USB port, IEEE 1394 (FireWire) port, and/or RS-232 port.

Mobile device 1000 can also include antennas 1094 and multiband decoupling network 1092. Mobile device 1000 can also include one or more matching networks (not shown). The illustrated components 1002 are not required or all-inclusive, as any components can deleted and other components can be added.

Exemplary Operating Environment

Figure 11:
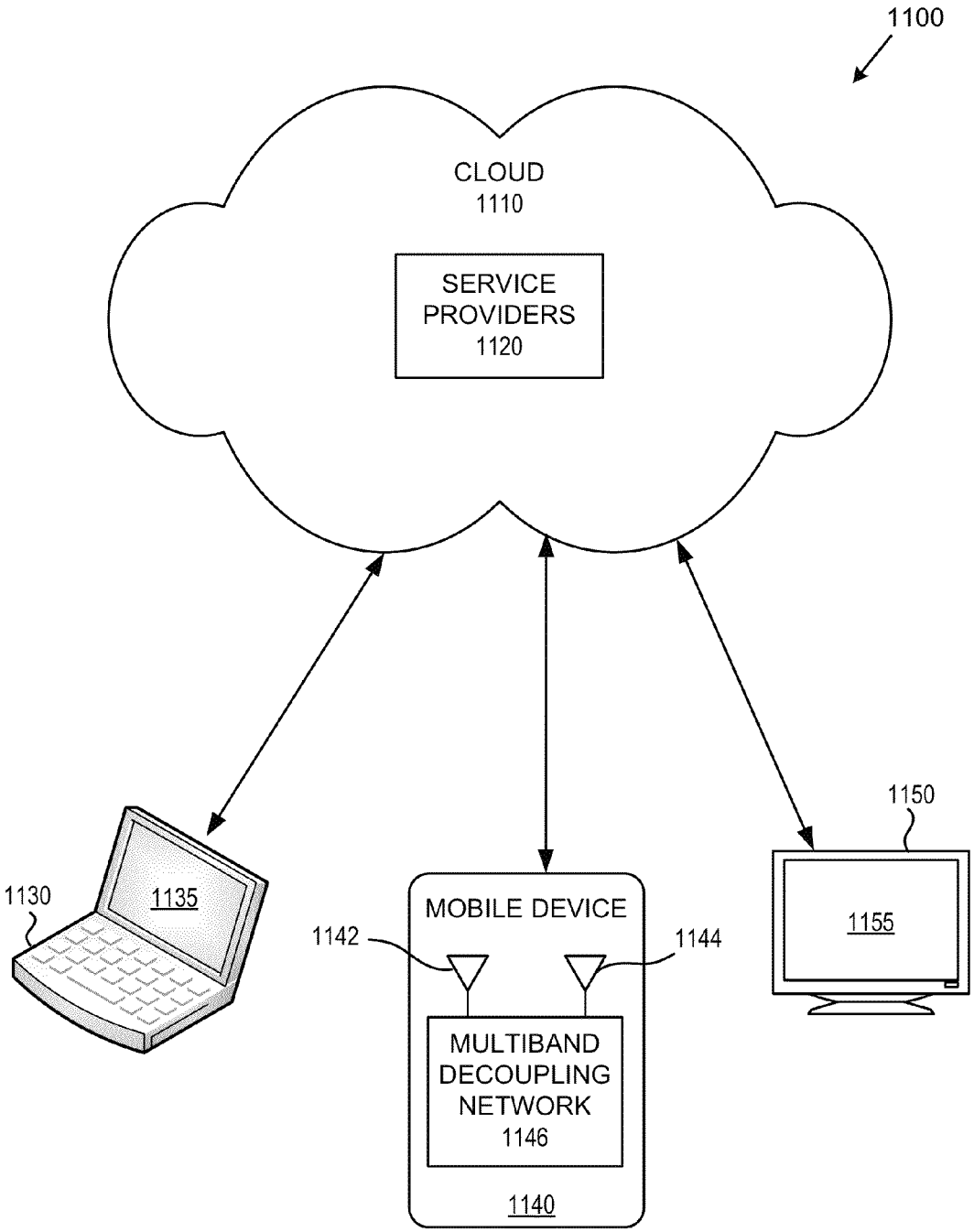
FIG. 11 is a diagram illustrating a generalized example of a suitable implementation environment for any of the disclosed embodiments.

FIG. 11 illustrates a generalized example of a suitable implementation environment 1100 in which described embodiments, techniques, and technologies may be implemented.

In example environment 1100, various types of services (e.g., computing services) are provided by a cloud 1110. For example, the cloud 1110 can comprise a collection of computing devices, which may be located centrally or distributed, that provide cloud-based services to various types of users and devices connected via a network such as the Internet. The implementation environment 1100 can be used in different ways to accomplish computing tasks. For example, some tasks (e.g., processing user input and presenting a user interface) can be performed on local computing devices (e.g., connected devices 1130, 1140, 1150) while other tasks (e.g., storage of data to be used in subsequent processing) can be performed in the cloud 1110.

In example environment 1100, the cloud 1110 provides services for connected devices 1130, 1140, 1150 with a variety of screen capabilities. Connected device 1130 represents a device with a computer screen 1135 (e.g., a mid-size screen). For example, connected device 1130 could be a personal computer such as desktop computer, laptop, notebook, netbook, or the like. Connected device 1140 represents a device with a mobile device screen 1145 (e.g., a small size screen). For example, connected device 1140 could be a mobile phone, smart phone, personal digital assistant, tablet computer, or the like. Connected device 1150 represents a device with a large screen 1155. For example, connected device 1150 could be a television screen (e.g., a smart television) or another device connected to a television (e.g., a set-top box or gaming console) or the like. One or more of the connected devices 1130, 1140, 1150 can include touchscreen capabilities. Touchscreens can accept input in different ways. For example, capacitive touchscreens detect touch input when an object (e.g., a fingertip or stylus) distorts or interrupts an electrical current running across the surface. As another example, touchscreens can use optical sensors to detect touch input when beams from the optical sensors are interrupted. Physical contact with the surface of the screen is not necessary for input to be detected by some touchscreens. Devices without screen capabilities also can be used in example environment 1100. For example, the cloud 1110 can provide services for one or more computers (e.g., server computers) without displays.

Services can be provided by the cloud 1110 through service providers 1120, or through other providers of online services (not depicted). For example, cloud services can be customized to the screen size, display capability, and/or touchscreen capability of a particular connected device (e.g., connected devices 1130, 1140, 1150).

In example environment 1100, the cloud 1110 provides the technologies and solutions described herein to the various connected devices 1130, 1140, 1150 using, at least in part, the service providers 1120. For example, the service providers 1120 can provide a centralized solution for various cloud-based services. The service providers 1120 can manage service subscriptions for users and/or devices (e.g., for the connected devices 1130, 1140, 1150 and/or their respective users).

In some embodiments, data is uploaded to and downloaded from the cloud using antennas 1142 and 1144 of mobile device 1140. Antennas 1142 and 1144 are decoupled using multiband decoupling network 1146. Multiband decoupling networks can also be implemented on other connected devices such as connected devices 1130 and 1150.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions stored on one or more computer-readable storage media (e.g., one or more optical media discs, volatile memory components (such as DRAM or SRAM), or nonvolatile memory components (such as flash memory or hard drives)) and executed on a computer (e.g., any commercially available computer, including smart phones or other mobile devices that include computing hardware). As should be readily understood, the term computer-readable storage media does not include communication connections, such as modulated data signals. Any of the computer-executable instructions for implementing the disclosed techniques as well as any data created and used during implementation of the disclosed embodiments can be stored on one or more computer-readable media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

It should also be well understood that any functionality described herein can be performed, at least in part, by one or more hardware logic components, instead of software. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

We claim:

1. The multiband antenna decoupling network comprising:

a first reconfigurable element having a reactance, an antenna-side end, and a system-side end;

a second reconfigurable element having a reactance, an antenna-side end, and a system-side end;and a third reconfigurable element having a susceptance that is connected in shunt between the system-side ends of the first and second reconfigurable elements, wherein the multiband decoupling network is reconfigured to decouple at least two antennas at a plurality of distinct communication frequency bands, and wherein the first reconfigurable element comprises a tunable lumped component and an additional reactive section that are switchably connectable into a signal path of a first antenna of the at least two antennas such that when the tunable lumped component is switched into the signal path, the additional reactive section is switched out of the signal path, and when the additional reactive section is switched into the signal path, the turnable lumped component is switched out of the signal path.

2. The multiband antenna decoupling network of claim 1, wherein the additional reactive section comprises a lumpled component.

3. The multiband antenna decoupling network of claim 2, wherein the lumped component of the additional reactive section is a tunable lumped component.

4. The multiband antenna decoupling network of claim 1, wherein at least one of the second or third reconfigurable elements comprises a series or parallel lumpled-component resonator having at least one tunable lumped component.

5. The multiband antenna decoupling network of claim 1, wherein the second reconfigurable element comprises two or more lumped components that are switchably connectable into a signal path of a second antenna of the at least two antennas.

6. The multiband antenna decoupling network of claim 1, wherein the additional reactive section comprises a segment of transsion line configured to provide a reactance at the plurality of distinct communication frequency band.

7. The multiband antenna decoupling network of claim 6, wherein the additional reactive section further comprises a lumped component in series with the segment of transmission line.

8. The multiband antenna decoupling network of claim 7, wherein the lumped component in series with the segment of transmission line is a tunable lumped component.

9. The multiband antenna decoupling network of claim 1, wherein the second reconfigurable element comprises a tunable resonator comprising at least one tunable lumped component.

10. The multiband antenna decoupling network of claim 1, wherein the multiband decoupling network is reconfigurable to decouple the two or more antennas for at least six distinct communication frequency bands.

11. The multiband antenna decoupling network of claim 1, wherein the multiband antenna decoupling network is part of a mobile device.

12. A mobile device comprising:

at least two antennas;

a multiband decoupling network connected to the at least two antennas that is reconfigurable to decouple the two or more antennas at a plurality of distinct communication frequency bands, the multiband decoupling network comprising:

a first element having a reactance connected to a first of the at least two antennas, a second element having a reactance connected to a second of the at least two antennas, and a third element having a susceptance connected in shunt between the ends of the first and second elements opposite the first and second of the at least two antennas, wherein the first and second, elements each comprise at least one tunable lumped component and a segment of transmission line connected in series, wherein the reactance of the first and second elements is provided by the respective series combinations of the segment of transmission line and the at least one tunable lumped component, and wherein the multiband decoupling network is reconfigurable at least in part by tuning the at least one tunable lumped component of the first and second elements; and at least one impedance-matching network connected between the multiband decoupling network and at least one transmission line, the impedance-matching network providing an input impedance that substantially matches an output impedance of the at least one transmission line at the plurality of distinct communication frequency bands.

13. The mobile device of claim 12, wherein the third element comprises at least one lumped component.

14. The mobile device of claim 13, wherein the at least one lumped component of the third element is a tunable lumped component.

15. The mobile device of claim 12, wherein the multiband decoupling network is reconfigurable to decouple the at least two antennas for at least six distinct communication frequency bands.

16. A system comprising:

a first antenna;

a second antenna; and a multiband decoupling network connected to the first antenna and second antenna that is reconfigurable to decouple the first antenna and second antenna at a plurality of distinct communication frequency bands, the multiband decoupling network comprising:

a first element connected to a first antenna, the first element comprising at least one switch configured to switch two reactive sections into or out of a signal path to the first antenna, wherein at least one of the two reactive sections comprises a tunable lumped component, and wherein a reactance of the first element is determined by the reactive section switched into the signal path of the first antenna;

a second element connected to a second antenna, the second element comprising at least one switch configured to switch two reactive sections into or out of a signal path to the second antenna, wherein at least one of the two reactive sections comprises a tunable lumped component, and wherein a reactance of the second element is determined by the reactive section switched into the signal path of the second antenna; and a third element having a susceptance connected in shunt between the ends of the first and second elements opposite the first and second antennas.

17. The system of claim 16, wherein both of the two reactive sections of the first element and the second element comprise at least one tunable lumped component.

18. The system of claim 16, further comprising at least one impedance-matching network connected between the multiband decoupling network and at least one transmission line, the impedance-matching network providing an input impedance that substantially matches an output impedance of the at least one transmission line at the plurality of distinct communication frequency bands.

19. The system of claim 16, wherein the third element comprises at least one lumped component.

20. The system of claim 16, wherein the third element comprises at least one tunable lumped component.

* * * * *